United States Patent [19]

Carcas

[11] Patent Number: 4,594,750

[45] Date of Patent: Jun. 17, 1986

[54] RELEASABLE HINGE WITH SPRING BIASED PIN MOVING MECHANISM

[75] Inventor: Norman J. Carcas, Everett, Wash.

[73] Assignee: The Boeing Company, Seattle, Wash.

[21] Appl. No.: 672,364

[22] Filed: Nov. 16, 1984

[51] Int. Cl.[4] ..... E05D 7/10

[52] U.S. Cl. ..... 16/229; 16/257; 16/380

[58] Field of Search ..... 16/229, 257, 258, 262, 16/263, 380, 381, 386

[56] References Cited

U.S. PATENT DOCUMENTS

| | | | |
|---|---|---|---|
| 726,577 | 4/1903 | Schiek | 16/229 |
| 1,194,628 | 8/1916 | Hist . | |
| 1,332,591 | 3/1920 | Arthur . | |
| 1,904,110 | 4/1933 | Willmann . | |
| 2,534,998 | 12/1950 | Steinbach | 16/176 |
| 2,987,782 | 6/1961 | Kurowski | 20/16 |
| 3,006,025 | 10/1961 | Duban | 16/263 |
| 3,032,777 | 5/1962 | Young | 4/240 |
| 3,210,800 | 10/1965 | Navarro et al. | 16/176 |
| 3,510,986 | 5/1970 | Berkowitz | 49/386 |
| 3,671,998 | 6/1972 | Ruiz | 16/176 |
| 3,673,636 | 7/1942 | Ruiz | 16/175 |
| 3,908,227 | 9/1975 | Cain | 16/137 |
| 4,178,657 | 12/1979 | Way, Jr. | 16/173 |
| 4,307,486 | 12/1981 | Matsumoto | 16/261 |
| 4,455,711 | 6/1984 | Anderson | 16/386 X |

FOREIGN PATENT DOCUMENTS

| | | | |
|---|---|---|---|
| 2033465 | 5/1980 | United Kingdom | 16/257 |
| 2090323 | 7/1982 | United Kingdom | 16/265 |

*Primary Examiner*—Fred Silverberg
*Attorney, Agent, or Firm*—Joan H. Pauly

[57] ABSTRACT

Improvements in separable hinge mechanisms. A problem with such mechanisms is that, over a relatively long hinge axis, the hinge pins tend to bind due to misalignment. The invention provides positive alignment and minimizes off-center loads. Mechanism (8) has two opposing integral leaves (10, 20). Each leaf (10, 20) has a plurality of knuckles (12, 30, 32, 32') attached thereto. These form a plurality of axially spaced hinge stations (18). Each station (18) has a corresponding hinge pin (28). Each pin (28) is attached to one of two slide bars (22) that are mounted on leaf (20) for sliding movement parallel to axis (X). Bars (22) are mounted by a center mounting lug (42) and guide rod (46) that carries a spring abutment (26) for each bar (22). Leaves (10, 20) are separated by squeezing toward each other two adjacent finger tabs (24), one on each bar (22). This compresses two springs (48) mounted on rod (46) which bias the bars (22) and pins (28) into a position in which leaves (10, 20) are connected.

30 Claims, 12 Drawing Figures

Fig. 8
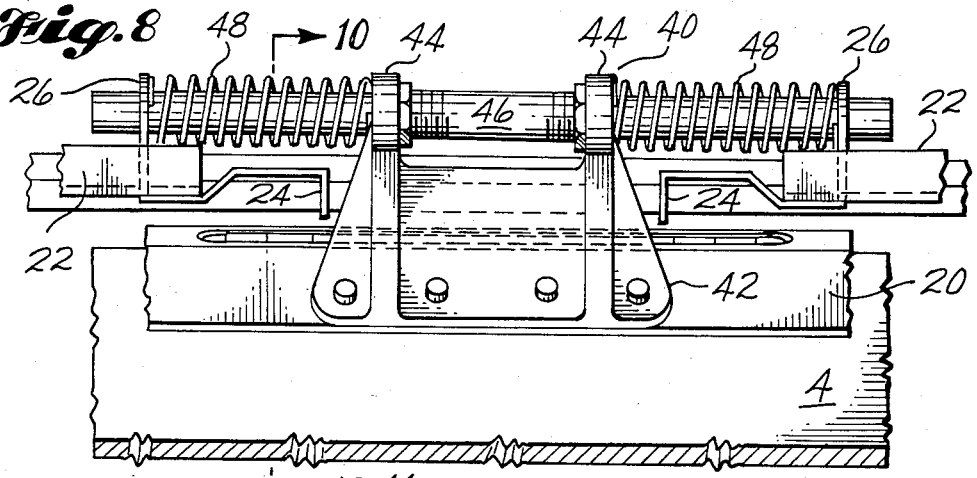
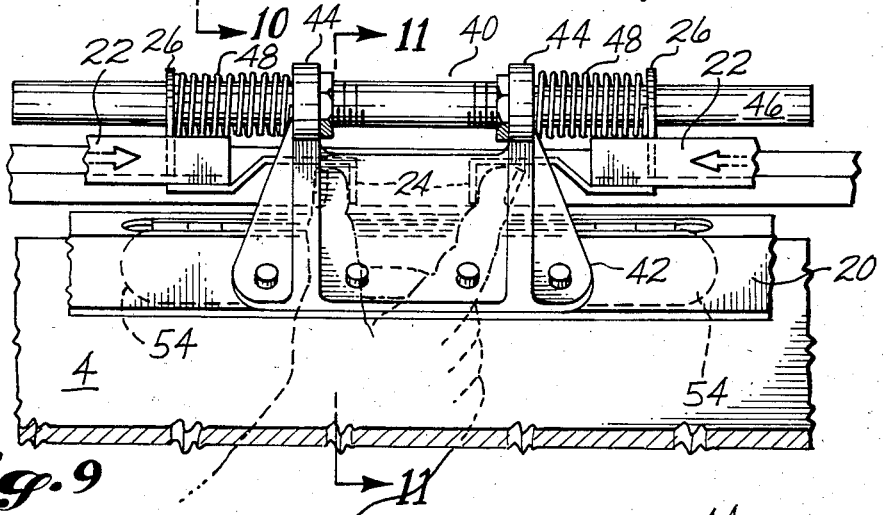
Fig. 9
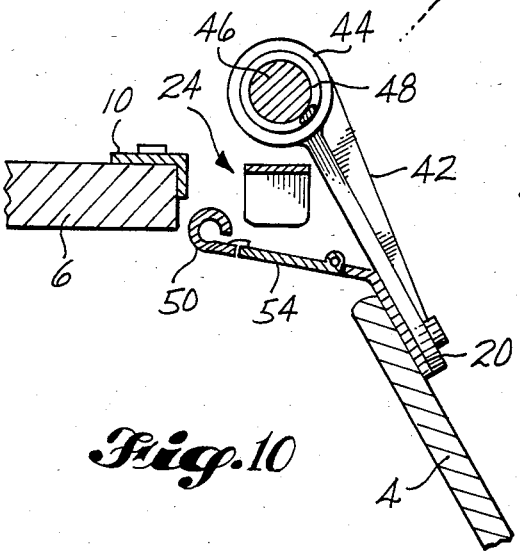
Fig. 10
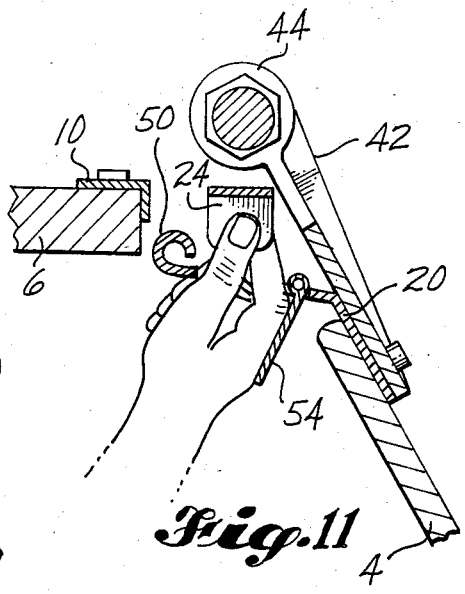
Fig. 11

RELEASABLE HINGE WITH SPRING BIASED PIN MOVING MECHANISM

TECHNICAL FIELD

This invention relates to hinges and, more particularly, to a releasable hinge in which a slide bar is attached to a plurality of hinge pins to slide the pins into and out of engagement with hinge knuckles and in which a centrally mounted spring biases the bar to bias the pins into an engaged position.

BACKGROUND ART

In certain known passenger aircraft, the entry and service doors open inward and upward into the overhead area above the ceiling panels. In order to permit passage of each door, the ceiling lining panels in the vicinity of the door must retract. Known retraction mechanisms include a hinge at the juncture of the ceiling panels and the door liner panels. Since important equipment is stored inside the door behind the door liner panels and since much of the door operating mechanism is located behind such panels, there must be access to the inside of the door for maintenance of the equipment and the door. Therefore, the hinge between the door and ceiling must be readily detachable in order to provide such access.

A known hinge structure that has been used at the juncture of the ceiling and door is a structure in which four discrete hinges are attached to two release bars in order to allow their quick release. Each of these four hinges includes a spring-loaded hinge pin; i.e., a hinge pin having its own separate spring bearing axially against it to urge it into an engaged position. The use of a hinge structure having discrete hinges and spring-loaded pins has presented a number of problems. Because of the difficulty in maintaining accurate alignment of the separate hinge segments along the relatively long hinge axis, the pins have a tendency to bind. This results in distortion of the structure and breakage of the release knobs. In addition, of necessity each spring in the hinge structure is relatively small and must be substantially fully compressed to disengage the hinge structure. Consequently, the life of the springs is relatively short, and thus, the maintenance costs relating to the hinge structure are relatively high.

The patent literature includes a number of examples of hinge structures that include a spring or springs. Such structures are disclosed in U.S. Pat. Nos.: 1,194,628, granted Aug. 15, 1916, to J. Hist; 1,332,591, granted Mar. 2, 1920, to K. B. Arthur; 1,904,110, granted Apr. 18, 1933, to P. Willmann; 2,534,998, granted Dec. 19, 1950, to W. Steinbach; 2,987,782, granted June 13, 1961, to W. J. Kurowski; 3,032,777, granted May 8, 1962, to S. L. Young; 3,210,800, granted Oct. 12, 1965, to R. W. Navarro et al; 3,510,986, granted May 12, 1970, to I. L. Berkowitz; 3,671,998, granted June 27, 1972, to J. A. Ruiz; 3,673,636, granted July 4, 1972, to J. A. Ruiz; 3,908,227, granted Sept. 30, 1975, to J. F. Cain; 4,178,657, granted Dec. 18, 1979, to L. V. Way, Jr.; and 4,307,486, granted Dec. 29, 1981, to S. Matsumoto.

Each of the above patents, except Way, Jr. and Matsumoto, discloses a hinge mechanism in which a spring or springs coaxial with the hinge pins urges the pins into an enraged position. The spring in the Matsumoto mechanism connects two hinge leaves and itself acts as a hinge pin. In the hinge mechanism disclosed by Way, Jr., two hinge pins are retractable into a center hinge knuckle. An actuating mechanism including two levers pivotably connected to each other is provided. One end of each lever is attached to one of the pins. To release the hinge mechanism, one of the levers is moved to impart a combination of pivotal and sliding motion to each of the two levers to in turn slide the hinge pins toward each other into the center hinge knuckle. A torsion spring oriented perpendicularly to the hinge axis is provided at the pivotal connection between the two levers to bias the levers into either one of their two extreme positions.

The known structures and the patents discussed above and the prior art discussed and/or cited in the patents should be carefully considered for the purpose of putting the present invention into proper perspective relative to the prior art.

DISCLOSURE OF THE INVENTION

The subject of this invention is a separable hinge mechanism. According to an aspect of the invention, the mechanism comprises a first portion and a second portion that is pivotable with respect to the first portion about a hinge axis. The first portion includes a plurality of hinge knuckles spaced along such axis. Each of these knuckles has an axial passageway therethrough. The second portion includes an integral plate-like member and a plurality of hinge knuckles each of which is attached to the plate-like member. The hinge knuckles of the first and second portions together define a plurality of axially spaced hinge stations. An elongated pin moving member is laterally spaced from, extends parallel to, and is slidable along the axis. The mechanism also includes a plurality of hinge pins, one corresponding to each hinge station. Each pin is attached to the elongated member to slide therewith and into and out from the passageway in a corresponding knuckle on the first portion. Mounting means is provided for slidably mounting the elongated member on the plate-like member. This mounting means includes a first spring abutment laterally spaced from the pins and attached to the elongated member, and a second spring abutment spaced from the first abutment in one direction along the axis. A spring is located between the abutments and is positioned to be compressed by sliding movement of the elongated member and the first abutment in said direction. Release means is provided for sliding the elongated member in said direction against the force of the spring to slide the pins out of the passageways to in turn disconnect the first and second portions.

The basic structure of the hinge mechanism of the invention described above has a number of features that combine to solve the problems mentioned above in connection with known structures. The mounting of the elongated pin moving member and the hinge knuckles of the second portion on an integral plate-like member gives the mechanism sufficient stability so that accurate alignment of the hinge stations may be maintained. The provision of the integral plate-like member also makes it easier to install the hinge mechanism in proper alignment. The separation of the spring from the hinge pins makes it possible to use a larger, stronger, and more durable spring without making the hinge mechanism unwieldy. The location of the spring, in combination with the provision of the integral plate-like member, also makes it possible to better control off-center loads that would tend to distort the mechanism and/or reduce its useful life. In addition, the use of a longer lasting spring helps to reduce maintenance costs.

According to another aspect of the invention, at each hinge station there are two knuckles attached to the plate-like member of the second portion and positioned to receive a knuckle of the first portion therebetween. Each of these two knuckles has an axial opening. The corresponding pin is dimensioned to extend into the opening in each of the two knuckles and through the passageway in the knuckle therebetween to hingedly connect the first and second portions of the mechanism. This arrangement provides support for the pin by the second portion on either side of the knuckle of the first portion. Such support strengthens the hinge mechanism and helps prevent shearing of the pins. This in turn further reduces maintenance and replacement costs.

A preferred feature of the invention is a first portion that includes an integral plate-like member to which each of the knuckles of the first portion is attached. This feature further contributes to the maintenance of the alignment of the hinge mechanism and to the ease of installing the mechanism in the proper alignment.

Another preferred feature of the invention is a spring that is dimensioned to be only partially compressed when the first and second portions are being disconnected. This feature helps to prolong the life of the spring by avoiding the relatively severe stresses associated with full compression of a spring.

According to another aspect of the invention, the elongated member has a laterally extending projection corresponding to each pin. Each projection is attached to the corresponding pin to attach the pin to the elongated member. At least one of the projections has an abutting surface adjacent to a knuckle of the second portion to provide a stop surface to limit movement of the elongated member and attached pins in a direction opposite to said one direction.

According to still another aspect of the invention, the elongated member has a laterally extending projection corresponding to each pin and attached to the corresponding pin to attach such pin to the elongated member. The spring is positioned adjacent to one end of the elongated member. The pin farthest from said one end has a knuckle engaging portion that extends axially from the corresponding projection, away from said one end, and through the passageway in a corresponding knuckle of the first portion. Such pin also has a guide portion that extends axially from the corresponding projection and toward said one end. The mechanism further comprises guide means having an axial opening that receives the end of the guide portion of the pin opposite the corresponding projection to guide movement of the elongated member along the axis. This arrangement helps to ensure the smooth functioning of the mechanism and to prevent any wobbling movement of the elongated member and/or pins about the axis.

The hinge mechanism of the invention may be provided with a single elongated pin moving member, but is preferably provided with two such members. According to a preferred aspect of the invention, the mechanism comprises a first portion and a second portion that is pivotable with respect to the first portion about a hinge axis. The first portion includes a plurality of hinge knuckles spaced along the axis, each such knuckle having an axial passageway therethrough. The second portion includes an integral plate-like member and a plurality of hinge knuckles each of which is attached to such member. The hinge knuckles of the first and second portions together define a plurality of axially spaced hinge stations. The two axially spaced elongated pin moving members are each laterally spaced from, extend parallel to, and are slidable along the axis. The mechanism includes a plurality of hinge pins, one corresponding to each hinge station. Each pin is attached to one of the elongated members to slide therewith and into and out from the passageway in a corresponding knuckle on the first portion. Mounting means is provided for slidably mounting the elongated members on the plate-like member. This mounting means includes a spring abutment corresponding to each elongated member. Each such abutment is laterally spaced from the pins and attached to the corresponding elongated member. Spring means is located between the abutments and positioned to be compressed by relative sliding movement of the elongated members toward each other. The mechanism has release means for sliding the elongated members toward each other against the force of the spring means to slide the pins out of the passageways to in turn disconnect the first and second portions.

The provision of the mechanism with two pin moving members has the advantage of making it possible to minimize off-center loads without affecting the ease of operation of the mechanism. In embodiments of the invention having four or more hinge stations, there are preferably a plurality of pins attached to each pin moving member. This helps to minimize off-center loads and to maximize the efficiency of the two pin moving member configuration.

The mounting means preferably comprises a mounting lug attached to an axially center portion of the plate-like member of the second portion. This lug carries the spring abutment attached to each of the elongated pin moving members. This center location for the mounting means helps to minimize off-center loads and maximize the efficiency of operation of the mechanism. Preferably, the mounting lug includes two axially spaced ears positioned between and axially aligned with the spring abutments attached to the elongated members. The spring means comprises two springs, one positioned between each abutment and an adjacent ear.

In the preferred embodiment, the release means comprises two adjacent finger tabs, one attached to each elongated member. These tabs are shaped and positioned to be squeezed toward each other by the thumb and index finger of an operator's hand. The tabs are preferably aligned with the elongated members and not laterally offset therefrom away from the pins. This helps to minimize off-set loads on the pins and maximize the smooth functioning of the mechanism. Preferably, the plate-like member of the second portion has an access opening therein to provide access to the tabs. The provision of such an access opening makes it possible to hide the mounting means behind the structures being connected by the hinge mechanism without sacrificing ease of operation of the mechanism.

The advantages and features discussed above, as well as other advantages and features of the invention, will become apparent from the detailed description of the Best Mode for Carrying out the Invention that follows.

BRIEF DESCRIPTION OF THE DRAWINGS

In the drawings, like element designations refer to like parts throughout, and:

FIG. 8 is a pictorial view of the center portion of the mechanism and panel fragments shown in FIG. 2.

FIG. 9 is like FIG. 8 except that it shows the hand of an operator moving the pin moving members to disconnect the two portions of the mechanism from each other.

FIG. 10 is a sectional view taken along the line 10—10 in FIG. 8.

FIG. 11 is a sectional view taken along the line 11—11 in FIG. 9.

BEST MODE FOR CARRYING OUT THE INVENTION

Figure 1:
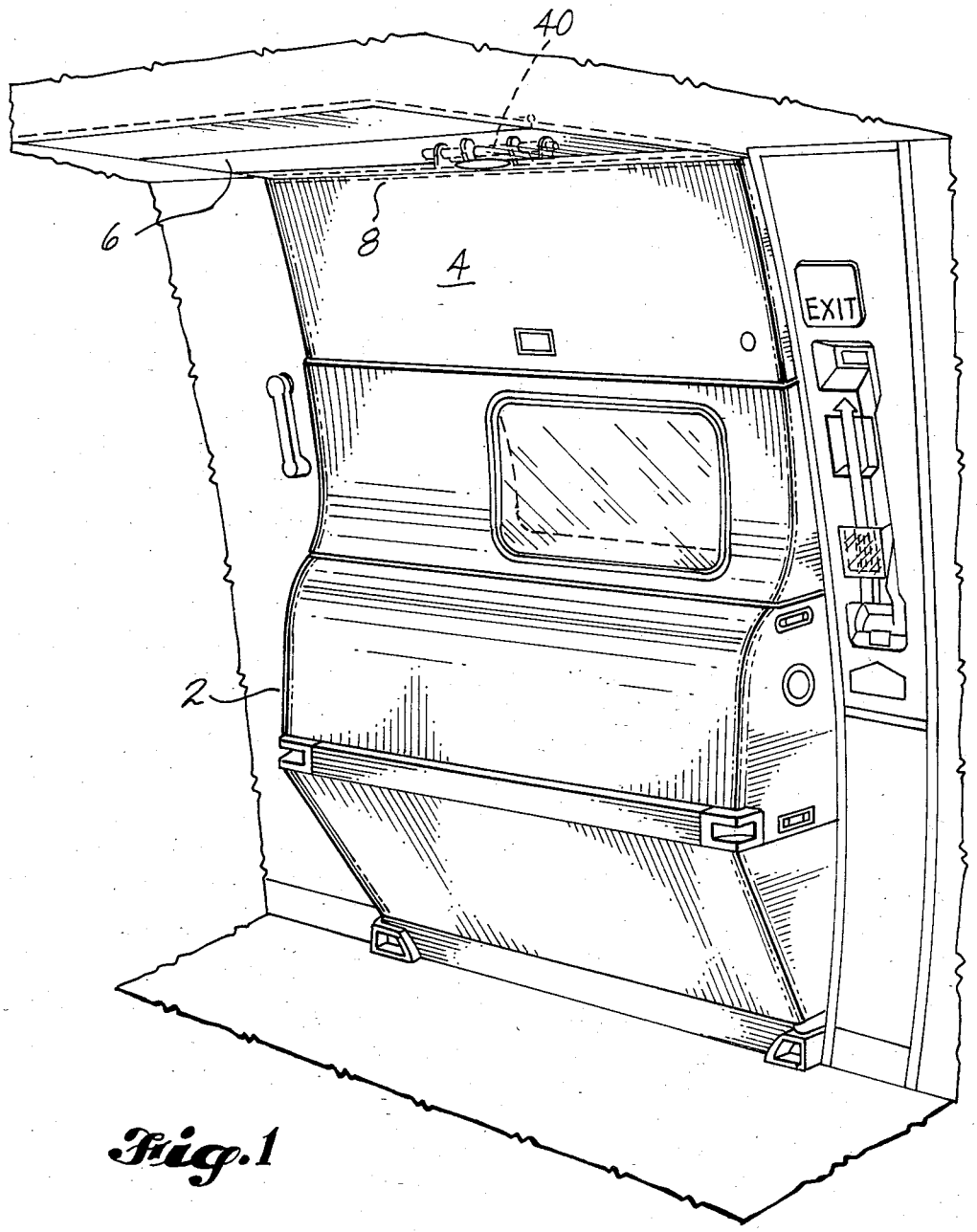
FIG. 1 is a pictorial view of the interior of a passenger aircraft entry door and its surrounding structure into which the preferred embodiment of the mechanism of the invention has been incorporated.
Figure 2:
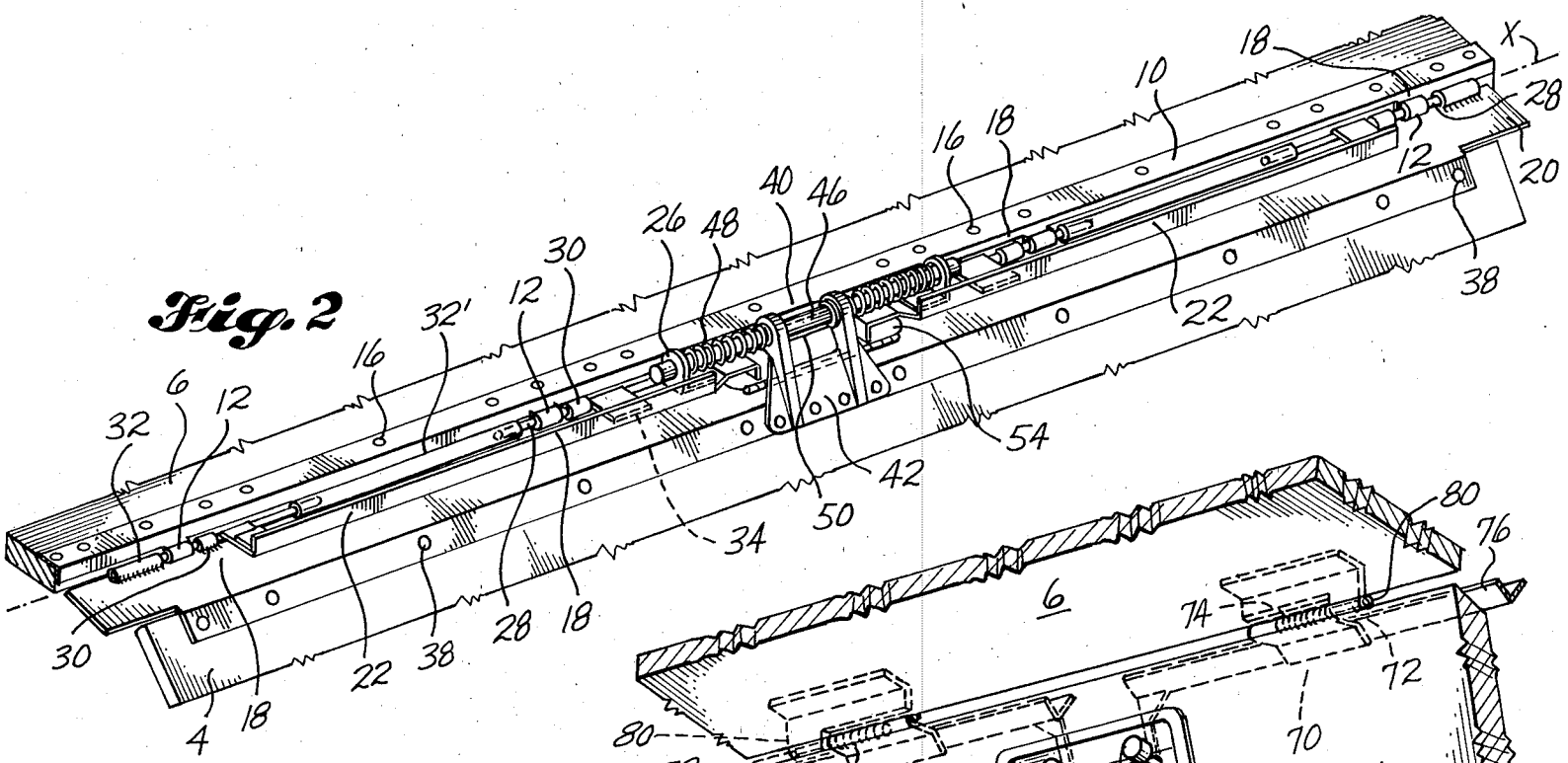
FIG. 2 is a pictorial view of the preferred embodiment of the mechanism and portions of the panels to which the mechanism is attached in FIG. 1.

The drawings show a hinge mechanism 8 that is constructed according to the invention and that also constitutes the best mode of the invention currently known to the applicant. FIG. 1 illustrates the anticipated primary use for the mechanism of the invention. FIG. 1 shows the mechanism 8 installed in a passenger aircraft to hingedly connect the upper door liner panel 4 of an entry door 2 to the adjacent ceiling panel 6. This installation is shown and described herein for the purpose of illustrating a typical use environment of the hinge mechanism of the invention. It is of course to be understood that the mechanism may also be used to advantage in a wide variety of other situations without departing from the spirit and scope of the invention.

Figure 12:
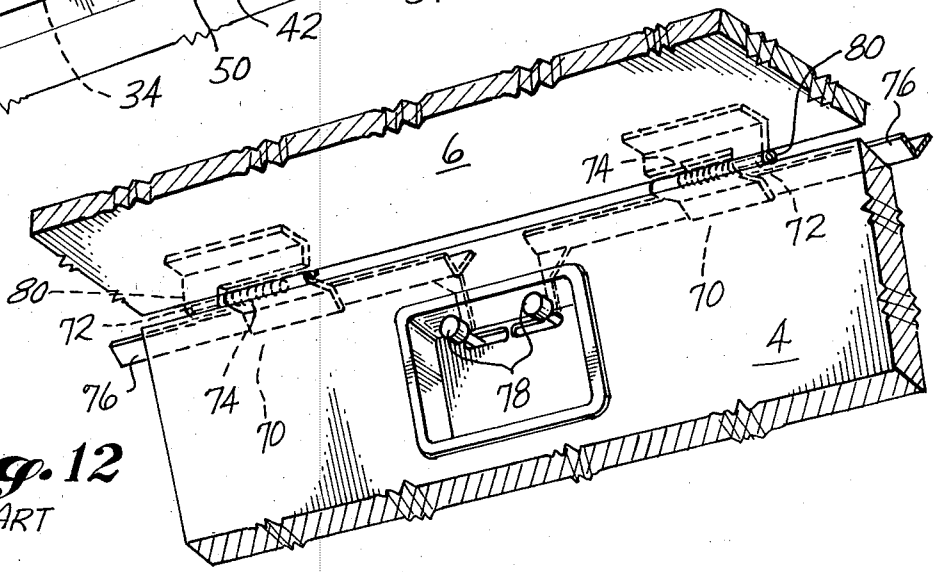
Fig. 12 PRIOR ART
FIG. 12 is a pictorial view of the center portion of a previously used hinge mechanism, showing the two center discrete hinge structures.

For the purposes of comparison, FIG. 12 illustrates a type of hinge mechanism that has previously been used in the kind of environment shown in FIG. 1. This type of mechanism is briefly described above in the Background Art section. As noted above, the mechanism includes four discrete and separate hinges 70. Two of the separate hinges 70 are shown in FIG. 12. Each hinge 70 has a hinge pin 72 and an axial spring 74 that bears against one end of the pin 72 to urge it into an engaged position. The pins 72 are connected to two levers 76 that slide to slide the pins 72 in and out of engagement with associated knuckles 80. The levers 76 are operated by knobs 78.

The hinge mechanism 8 of the preferred embodiment of the invention includes a first portion and a second portion which are pivotable with respect to each other about a hinge axis X. Each of the two portions includes an integral plate-like member or leaf 10, 20. The first portion of the mechanism 8 also includes a plurality of hinge knuckles 12 spaced along the axis X. In the preferred embodiment shown in the drawings, there are four such knuckles 12, but of course this number could be varied without departing from the spirit and scope of the invention. Each of the knuckles 12 has an axial passageway 14 extending therethrough. The knuckles 12 may be formed separately from the leaf 10 and then attached thereto, or they may be attached to the leaf 10 by being formed integrally therewith. The leaf 10 of the first portion has a number of holes 16 for receiving fasteners to fasten the first portion to one of the panels 4, 6 being hingedly connected by the hinge mechanism 8. In the preferred embodiment shown in the drawings, the first portion is connected to the ceiling panel 6.

The integral leaf 20 of the second portion also has a plurality of hinge knuckles 30, 32, 32' attached thereto and a plurality of holes 38 for fasteners. In the preferred embodiment, leaf 20 is fastened to door panel 4. As with the first portion, the knuckles 30, 32, 32' of the second portion may be fabricated separately and then attached or formed integrally with the leaf 20. The hinge knuckles 12, 30, 32, 32' of the first and second portions together define a plurality of axially spaced hinge stations 18. This arrangement of a plurality of axially spaced stations 18 on a single leaf 20, as opposed to a plurality of separate hinges, has the advantages relating to alignment discussed above.

In the preferred embodiment, at each hinge station 18 there are three knuckles 12, 30, 32 (32'), one knuckle 12 attached to the first leaf 10 and two knuckles 30, 32 (32') attached to the second leaf 20. In the assembled mechanism 8, the knuckle 12 of the first portion is positioned axially between the two knuckles 30, 32 (32') of the second portion. This arrangement makes it possible to provide support by the second portion for a hinge pin on either side of the knuckle 12 of the first portion. A hinge pin 28 is provided at each hinge station 18. At each station 18, a center portion of the pin 28 extends through the passageway 14 in the knuckle 12 of the first portion, and opposite end portions of the pin 28 extend into axial openings 31, 33 in the respective knuckles 30, 32 (32') of the second portion. This provides the desired support on either side of the knuckle 12.

The mechanism of the invention also includes an elongated pin moving member or slide bar 22. In the preferred embodiment as shown in the drawings, two such slide bars 22 are provided. Each of the pins 28 is attached to one of the slide bars 22. In order to make maximum use of the two-bar arrangement, it is preferable that an equal number of pins 28 be attached to each bar 22. In the preferred embodiment, there are four pins 28, two of which are attached to each slide bar 22. Each pin 28 is attached to its slide bar 22 by means of an attaching member 34 that forms a laterally extending projection on the slide bar 22. The member 34 is attached to each of the slide bar 22 and the pin 28. Each member or projection 34 has a radial abutting surface 35 facing and adjacent to the knuckle 30 on the side of the knuckle 12 nearest the center of the mechanism 8. This abutting surface 35 functions as a stop surface to limit movement of the slide bar 22 and attached pins 28 in an axial direction away from the center of the mechanism 8 and toward an engaged position. An opposite radial surface 36 on each projection 34 also acts as an abutting surface to limit movement of the slide bar 22 and attached pins 28 in the opposite axial direction. Surfaces 36 abut knuckle 32' and guide member 50 (described below) to limit such movement and prevent overcompression of springs 48 (also described below).

Each of the slide bars 22 is laterally spaced from, extends parallel to, and is slidable along the hinge axis X. Because of the attachment of the pins 28 to the slide bars 22, each pin 28 slides with its corresponding slide bar 22 along the axis X and thus slides into and out from the passageway 14 in the corresponding knuckle 12. This accomplishes the connection and separation of the two portions of the hinge mechanism 8.

Each slide bar 22 is slidably mounted on the second leaf 20. The bars 22 are mounted for sliding movement along the axis X. The mounting means 40 that mounts the two bars 22 is best shown in FIGS. 8 and 9. It includes a mounting lug 42 having two ears 44. These ears 44 are laterally spaced from the axis X and are axially spaced from each other along a direction parallel to the axis X. Each ear 44 has an axial hole extending therethrough through which a guide rod 46 extends axially. The mounting means 40 also includes a spring abutment 26 corresponding to each of the slide bars 22. Each abutment 26 is attached to its corresponding bar 22. The abutments 26 are axially aligned with the ears 44, and each has an axial hole extending therethrough. The guide rod 46 extends parallel to the axis X through the axial opening in one of the abutments 26, then through the openings in the ears 44, and then through the opening in the other abutment 26. The radial surface of each of the ears 44 facing the corresponding abutment 26 forms a second spring abutment corressponding to each slide bar 22.

A coil spring 48 is positioned between each abutment 26 and the facing second abutment formed by the corresponding ear 44. The guide rod 46 extends through each of the springs 48. Each spring 48 abuts its corresponding spring abutment 26 and the facing radial surface of the corresponding ear 44. By this arrangement, when the two slide bars 22 are moved axially toward each other to release the hinge mechanism 8 and separate the first and second portions, each spring 48 is compressed between its spring abutment 26 and ear 44. Preferably, each spring 48 is dimensioned so that it will only partially compress, in the order of about fifty percent compression, when the two portions are being disconnected.

Preferably, the hinge mechanism of the invention is provided with guide means for guiding movement of the pin moving slide bars 22 along the axis X. In the preferred embodiment, each pin 28 has a knuckle engaging portion that extends axially from the corresponding attaching projection 34 and away from the axial center of the mechanism 8. The knuckle engaging portion extends from its projection 34, through the axial opening 31 in the knuckle 30, through the passageway 14 in the knuckle 12, and then into the opening 33 in the knuckle 32, 32' . Each pin 28 also has a guide portion that extends axially from the corresponding projection 34 and toward the center of the hinge mechanism 8. The end of the guide portion nearest the center of the mechanism 8 extends into an axial opening in a guide member 32', 50 and slides therein to provide the desired guidance of the movement of the slide bar 22. In the preferred embodiment, a center guide member 50, resembling an elongated knuckle, engages the center two pins 28 of the mechanism 8, and the axially outermost knuckle 32' corresponding to each of the two centermost pins 28 has an axially elongated configuration to provide a guide member for the guide portion of the pin 28 spaced axially outwardly from the adjacent center pin 28. This arrangement effectively and efficiently provides the desired guidance.

Figure 3:
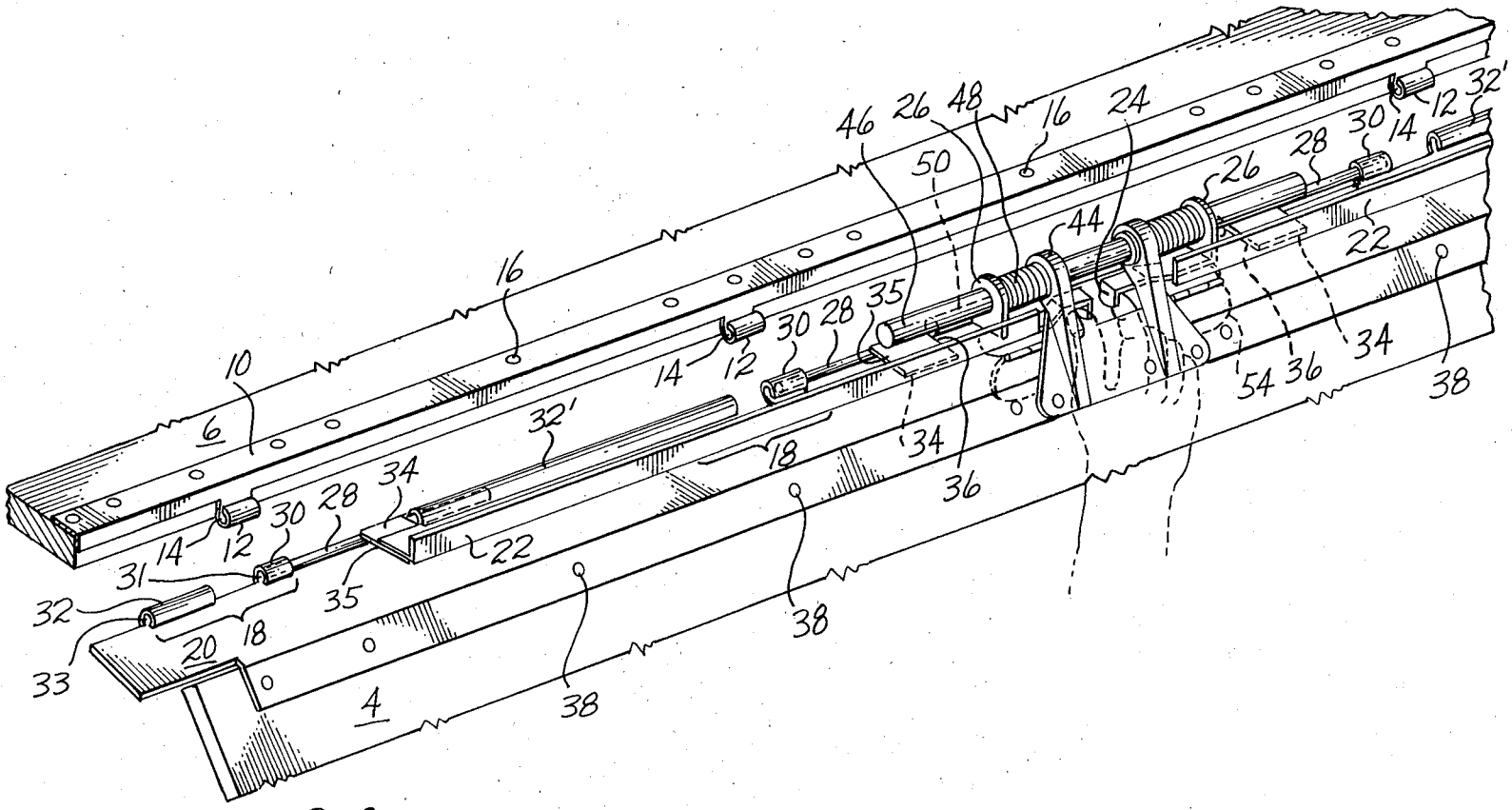
FIG. 3 is a pictorial view of a portion of the mechanism and fragments of panels shown in FIG. 2, with the two portions of the mechanism shown detached from each other and a hand of an operator holding the pin moving members together into their release positions.
Figure 4:
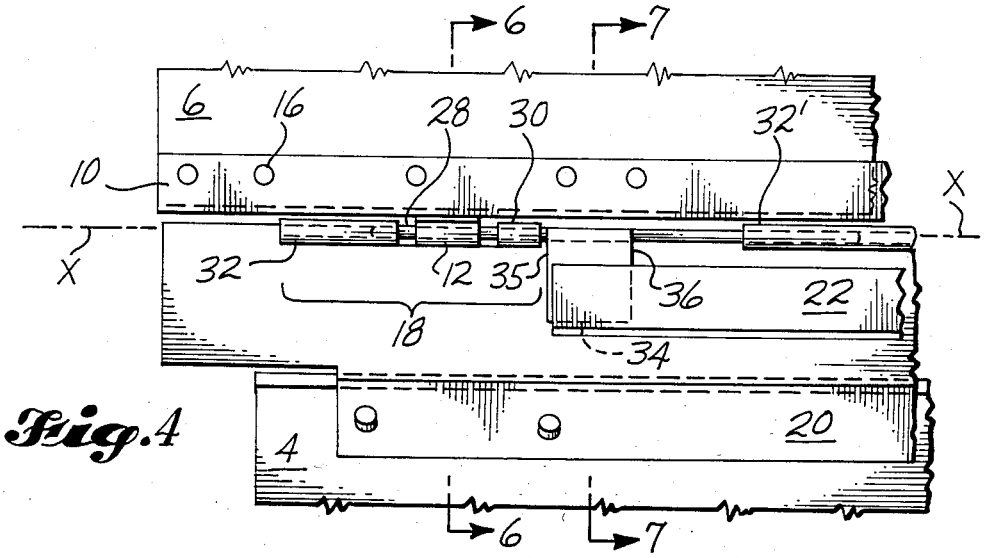
FIG. 4 is a plan view of an end portion of the mechanism and panel fragments shown in FIG. 2.
Figure 5:
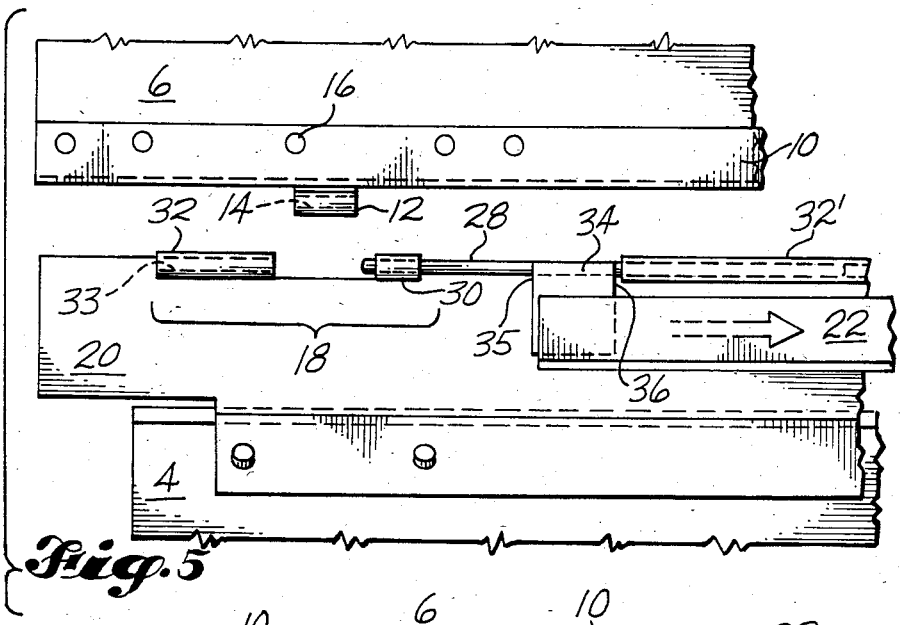
FIG. 5 is like FIG. 4 except that it shows the two portions of the mechanism separated from each other.
Figure 6:
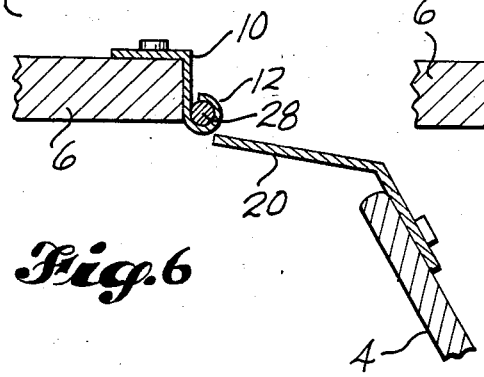
FIG. 6 is a sectional view taken along the line 6—6 in FIG. 4.
Figure 7:
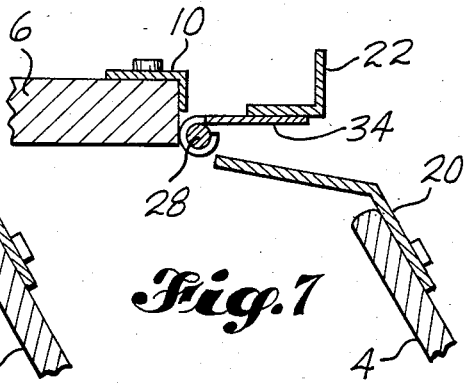
FIG. 7 is a sectional view taken along the line 7—7 in FIG. 4.

The operation of the mechanism 8 may be easily and quickly carried out. (See FIGS. 3, 9, and 11.) An access opening is provided in the second leaf 20 at the longitudinal center of the leaf 20 and laterally adjacent to the mounting lug 42. The opening is provided with a hinged cover 54. Each of the slide bars 22 has a radially extending finger tab 24 that extends generally toward the access opening. All that is required to release the two portion of the hinge mechanism 8 from each other is for an operator to open the cover 54, place a thumb on one finger tab 24 and an index finger on the other tab 24, and squeeze the two tabs toward each other. This moves the two bars 22 toward each other and each of the pins 28 out of the passageway 14 in its corresponding knuckle 12. With the pins 28 out of engagement with the knuckles 12, the two panels 4, 6 are free to move away from each other. In order to reconnect the two panels 4, 6 the tabs 24 are squeezed together to retract the pins 28, the panels 4, 6 are moved together with the knuckles 12 between the knuckles 30, 32 (32'), and the tabs 24 are released. The biasing action of the springs 48 automatically moves the pins 28 into engagement with the knuckles 12.

It will be obvious to those skilled in the art to which this invention is addressed that the invention may be used to advantage in a variety of situations. Therefore it is also to be understood by those skilled in the art that various changes, modifications, and omissions in form and detail may be made without departing from the spirit and scope of the present invention as defined by the following claims.

What is claimed is:

1. A separable hinge mechanism comprising:

a first portion including a plurality of hinge knuckles spaced along a common axis, each such knuckle having an axial passageway therethrough;

a second portion that is pivotable with respect to said first portion about said axis and that includes an integral plate-like member, and a plurality of hinge knuckles each of which is attached to said member; said hinge knuckles of said first and second portions together defining a plurality of axially spaced hinge stations;

an axially elongated pin moving member that is laterally spaced from, extends parallel to, and is slidable along said axis;

a plurality of hinge pins, one corresponding to each hinge station, each such pin being attached to the elongated member to slide therewith and into an out from the passageway in a corresponding knuckle on said first portion;

mounting means for slidably mounting the elongated member on the plate-like member; said mounting means including a first spring abutment laterally spaced from the pins and attached to the elongated member, and a second spring abutment spaced from said first abutment in one direction along said axis;

a spring located between said abutments and positioned to be compressed by sliding movement of the elongated member and said first abutment in said direction; and release means for sliding the elongated member in said direction against the force of the spring to slide the pins out of the passageways to in turn disconnect said first and second portions.

2. A mechanism as described in claim 1, in which, at each said hinge station, there are two knuckles attached to the plate-like member of the second portion and positioned to receive a knuckle of the first portion therebetween, each of said two knuckles has an axial opening, and said pin corresponding to said hinge station is dimensioned to extend into the opening in each of said two knuckles and through the passageway in the knuckle therebetween to hingedly connect said first and second portions, so that the pin is supported by said second portion on either side of the knuckle of the first portion.

3. A mechanism as described in claim 1, in which said first portion further includes an integral plate-like member to which each of the knuckles of the first portion is attached.

4. A mechanism as described in claim 1, in which the spring is dimensioned to be only partially compressed when the first and second portions are being disconnected, to prolong the life of the spring.

5. A mechanism as described in claim 1, in which the elongated member has a plurality of laterally extending projections, one corresponding to each said pin, each of said projections being attached to the corresponding pin to attach such pin to the elongated member; and at least one of said projections has an abutting surface adjacent to a knuckle of the second portion to provide a stop surface to limit movement of the elongated member and attached pins in a direction opposite to said one direction.

6. A mechanism as described in claim 5, in which said one of said projections has a second abutting surface opposite said abutting surface and adjacent to a fixed portion of the second portion to provide a stop surface to limit movement of the elongated member and attached pins in said one direction and to prevent overcompression of the spring.

7. A mechanism as described in claim 1:

in which the elongated member has a plurality of laterally extending projections, one corresponding to each said pin, each of said projections being attached to the corresponding pin to attach such pin to the elongated member; the spring is positioned adjacent to one end of the elongated member; and the pin farthest from said one end has a knuckle engaging portion that extends axially from the corresponding projection, away from said one end, and through the passageway in the corresponding knuckle of the first portion, and a guide portion that extends axially from the corresponding projecton and toward said one end; and which further comprises guide means having an axial opening that receives the end of said guide portion of the pin opposite the corresponding projection to guide movement of the elongated member along said axis.

8. A mechanism as described in claim 7, in which at least one of said projections has an abutting surface adjacent to a knuckle of the second portion to provide a stop surface to limit movement of the elongated member and attached pins in a direction opposite to said one direction.

9. A mechanism as described in claim 8, in which, at each said hinge station, there are two knuckles attached to the plate-like member of the second portion and positioned to receive a knuckle of the first portion therebetween; each of said two knuckles has an axial opening; and the knuckle engaging portion of the corresponding pin is dimensioned to extend through the opening in one of said two knuckles, through the passageway in the knuckle therebetween, and into the opening in the other of said two knuckles to hingedly connect said first and second portions, so that the knuckle engaging portion of the pin is supported by said second portion on either side of the knuckle of the first portion.

10. A mechanism as described in claim 7, in which, at each said hinge station, there are two knuckles attached to the plate-like member of the second portion and positioned to receive a knuckle of the first portion therebetween; each of said two knuckles has an axial opening; and the knuckle engaging portion of the corresponding pin is dimensioned to extend through the opening in one of said two knuckles, through the passageway in the knuckle therebetween, and into the opening in the other of said two knuckles to hingedly connect said first and second portions, so that the knuckle engaging porton of the pin is supported by said second portion on either side of the knuckle of the first portion.

11. A separable hinge mechanism comprising:

a first portion including a plurality of hinge knuckles spaced along a common axis, each such knuckle having an axial passageway therethrough;

a second portion that is pivotable with respect to said first portion about said axis and that includes an integral plate-like member, and a plurality of hinge knuckles each of which is attached to said member; said hinge knuckles of said first and second portions together defining a plurality of axially spaced hinge stations;

two axially spaced, axially elongated pin moving members that are each laterally spaced from, extend parallel to, and are slidable along said axis;

a plurality of hinge pins, one corresponding to each hinge station, each such pin being attached to one of the elongated members to slide therewith and into and out from the passageway in a corresponding knuckle on said first portion;

mounting means for slidably mounting the elongated members on the plate-like member; said mounting means including a plurality or spring abutment with a spring abutment corresponding to each elongated member, each said abutment being laterally spaced from the pins and attached to the corresponding elongated member;

spring means located between said abutments and positioned to be compressed by relative sliding movement of the elongated members toward each other; and release members for sliding the elongated members toward each other against the force of the spring means to slide the pins out of the passageways to in turn disconnect said first and second portions.

12. A mechanism as described in claim 11, in which there are a plurality of pins attached to each elongated member.

13. A mechanism as described in claim 12, in which there is an equal number of pins attached to each said elongated member.

14. A mechanism as described in claim 11, in which the mounting means comprises a mounting lug attached to an axially center portion of the plate-like member, said lug carrying the spring abutment attachment to each of said elongated members.

15. A mechanism as described in claim 14, in which the mounting lug includes two axially spaced ears positioned between and axially aligned with said abutments;

and the spring means comprises two springs, one positioned between each said abutment and an adjacent ear.

16. A mechanism as described in claim 14, in which the release means comprises two adjacent finger tabs, one attached to each elongated member, said tabs being shaped and positioned to be squeezed toward each other by the thumb and index finger of an operator's hand.

17. A mechanism as described in claim 16, in which the tabs are aligned with the elongated members to minimize offset loads on the pins and maximize smooth functioning of the mechanism.

18. A mechanism as described in claim 13, in which the release means comprises two adjacent finger tabs, one attached to each elongated member, said tabs being shaped and positioned to be squeezed toward each other by the thumb and index finger of an operator's hand.

19. A mechanism as described in claim 18, in which the tabs are aligned with the elongated members to minimize offset loads on the pins and maximize smooth functioning of the mechanism.

20. A mechanism as described in claim 11, in which the release means comprises two adjacent finger tabs, one attached to each elongated member, said tabs being shaped and positioned to be squeezed toward each other by the thumb and index finger of an operator's hand.

21. A mechanism as described in claim 20, in which the plate-like member has an access opening therein to provide access to said tabs.

22. A mechanism as described in claim 20, in which the tabs are aligned with the elongated members to minimize offset loads on the pins and maximize smooth functioning of the mechanism.

23. A mechanism as described in claim 11, in which, at each said hinge station, there are two knuckles attached to the plate-like member of the second portion and positioned to receive a knuckle of the first portion therebetween, each of said two knuckles has an axial opening, and the corresponding pin is dimensioned to extend into the opening in each of said two knuckles and through the passageway in the knuckle therebetween to hingedly connect said first and second portions, so that the pin is supported by said second portion on either side of the knuckle of the first portion.

24. A mechanism as described in claim 11, in which the first portion further includes an integral plate-like member to which each of the knuckles of the first portion is attached.

25. A mechanism as described in claim 11, in which each spring is dimensioned to be only partially compressed when the first and second portions are being disconnected, to prolong the life of the springs.

26. A mechanism as described in claim 11, in which each elongated member has a plurality of laterally extending projections, one corresponding to each pin attached thereto, each of said projections being attached to the corresponding pin to attach such pin to the elongated member; and at least one of said projections on each elongated member has an abutting surface adjacent to a knuckle of the second portion to provide a stop surface to limit movement of the elongated member and attached pins in a direction away from the other elongated member.

27. A mechanism as described in claim 26, in which said one of said projections has a second abutting surface opposite said abutting surface and adjacent to a fixed portion of the second portion to provide a stop surface to limit movement of the attached elongated member and pins toward the other elongated member and to prevent overcompression of the spring means.

28. A mechanism as described in claim 11:

in which each elongated member has a plurality of laterally extending projections, one corresponding to each pin attached thereto, each of said projections being attached to the corresponding pin to attach such pin to the elongated member; the spring means is positioned adjacent to one end of each elongated member; and the pin attached to each elongated member farthest from said one end of the attached elongated member has a knuckle engaging portion that extends axially from the corresponding projection, away from said one end, and through the passageway in the corresponding knuckle of the first portion, and a quide portion that extends axially from the corresponding projection and toward said one end; and which further comprises guide means corresponding to each such guide portion, each guide means having an axial opening that receives the end of the corresponding guide portion opposite the corresponding projection to guide movement of the attached elongated member along said axis.

29. A mechanism as described in claim 28, in which at least one of said projections on each elongated member has an abutting surface adjacent to a knuckle of the second portion to provide a stop surface to limit movement of the elongated member and attached pins in a direction away from the other elongated member.

30. A mechanism as described in claim 11, in which there is an equal number of pins attached to each said elongated member.

* * * * *

UNITED STATES PATENT AND TRADEMARK OFFICE

CERTIFICATE OF CORRECTION

PATENT NO. : 4,594,750

DATED : June 17, 1986

INVENTOR(S) : Norman J. Carcas

It is certified that error appears in the above-identified patent and that said Letters Patent are hereby corrected as shown below:

Column 1, line 66, "enraged" should be -- engaged --.

Column 7, line 28, "corressponding" should be -- corresponding --.

Column 8, line 9, "portion" should be -- portions --.

Claim 10, Column 10, line 18, "porton" should be -- portion --.

Claim 11, Column 10, line 42, "or" should be -- of --.

Claim 11, Column 10, line 42, "abutment" should be -- abutments --.

Claim 14, Column 10, line 64, "attachment" should be -- attached --.

Claim 28, Column 12, line 34, "quide" should be -- guide --.

Signed and Sealed this

Twenty-third Day of December, 1986

*Attest:*

DONALD J. QUIGG

*Attesting Officer* *Commissioner of Patents and Trademarks*